United States Patent [19]

Glasener

[11] Patent Number: 5,065,913

[45] Date of Patent: Nov. 19, 1991

[54] POURING AND DISPENSING SPOUT FOR A CONTAINER

[76] Inventor: Thomas H. Glasener, 10185 Marquart Rd., New Carlisle, Ohio 45344

[21] Appl. No.: 503,729

[22] Filed: Apr. 3, 1990

[51] Int. Cl.[5] ..... B67D 3/00

[52] U.S. Cl. ..... 222/528; 222/1; 222/527; 222/567; 425/269; 425/275

[58] Field of Search ..... 222/1, 21, 204, 211, 222/212, 554, 562, 563, 526, 527-529, 567-570, 632, 511, 416; 425/269, 275, 274; 215/30, 31, 100 R; 220/85 R, 85 SP, DIG. 7; 138/118, 126; 141/331, 337, 24; 285/903

[56] References Cited

U.S. PATENT DOCUMENTS

| | | | |
|---|---|---|---|
| 381,236 | 4/1888 | Haines | 222/527 |
| 1,048,744 | 12/1912 | Schoop | 222/204 |
| 2,207,176 | 7/1940 | Phillips | 222/569 |
| 2,384,056 | 9/1945 | Trift | 425/269 |
| 2,792,976 | 5/1957 | Stewart | 222/569 |
| 2,922,613 | 1/1960 | Beacham et al. | 138/118 |
| 3,047,195 | 7/1962 | Richmond | 222/189 |
| 3,165,241 | 1/1985 | Curry | 222/511 |
| 3,986,538 | 10/1976 | Sather | 285/903 |
| 4,129,236 | 12/1978 | Wrycraft et al. | 222/570 |
| 4,274,555 | 6/1981 | Sneider | 222/566 |
| 4,492,324 | 1/1985 | Weber | 222/530 |
| 4,664,301 | 5/1987 | Hoyt | 222/538 |
| 4,695,241 | 9/1987 | Ventimiglia | 425/575 |
| 4,768,954 | 9/1988 | Dragan | 222/575 |
| 4,832,238 | 5/1989 | Taylor | 222/568 |
| 4,856,568 | 8/1989 | Murphy et al. | 220/855 P |

FOREIGN PATENT DOCUMENTS

| | | | |
|---|---|---|---|
| 688545 | 3/1953 | United Kingdom | 222/527 |

*Primary Examiner*—Michael S. Huppert
*Assistant Examiner*—Philippe Derakshani
*Attorney, Agent, or Firm*—Jacox & Meckstroth

[57] ABSTRACT

A spout has a resilient and flexible tubular body which is produced by dipping a heated mold into polyvinyl chloride to form a coating or layer. The layer is cured within an oven and then cooled and removed from the mold. The spout body includes a base inlet portion which is stretched onto or pressed into the annular threaded neck or outlet portion of a liquid container to retain the body and to form a liquid-tight seal. The internal passage defined by the tubular body is closed by the user pinching the body with his fingers after which the container is inverted, and the pinch is released to control the dispensing of the liquid from the container. Interchangeable hollow tip members are also produced by dip-molding, and each tip member is pressed onto the outlet end portion of the tubular body to form a cap or smaller discharge opening.

8 Claims, 1 Drawing Sheet

POURING AND DISPENSING SPOUT FOR A CONTAINER

BACKGROUND OF THE INVENTION

In the pouring and dispensing of a liquid from a container, such as the dispensing of motor oil or windshield cleaning solution or anti-freeze from a container of blow-molded plastics material, it is common to use a funnel to prevent spillage of the liquid when the container is inverted. However, sometimes a pouring spout is used in place of the funnel, and the spout is usually attached by an annular nut to the threaded annular neck portion of the container defining the outlet. Examples of pouring spouts for liquid containers are disclosed in U.S. Pat. No. 4,129,236, No. 4,664,301 and No. 4,832,238. As disclosed in these patents, the pouring spouts are molded of a rigid or semi-rigid plastics material and may incorporate a flexible bellows-like portion and an internal closure valve, for example, as disclosed in U.S. Pat. No. 4,832,238.

SUMMARY OF THE INVENTION

The present invention is directed to an improved pouring and dispensing spout for a liquid container and which is simple and inexpensive in construction and is also easy to use. The spout provides for conveniently closing the spout and for controlling the dispensing of the liquid after the container and the spout have been inverted.

In accordance with a preferred embodiment of the invention, the pouring and dispensing spout is formed by a dip-molding process wherein an elongated mold is heated and dipped into a liquid polyvinyl chloride (PVC) material, and the coating or layer of PVC on the mold is cured within an oven to form a hollow body. After the body is cooled on the mold, it is stripped from the mold with the use of air pressure, and the lower closed end portion of the body is then trimmed or removed to form a flexible and resilient tubular body. The body has an enlarged base portion which frictionally attaches to the threaded neck portion on the liquid container and forms a liquid-tight seal. Interchangeable tip members press onto the outer end portion of the body to form a cap or smaller discharge openings.

Other features and advantages of the invention will be apparent from the following description, the accompanying drawing and the appended claims.

DESCRIPTION OF THE PREFERRED EMBODIMENTS

Figure 1:
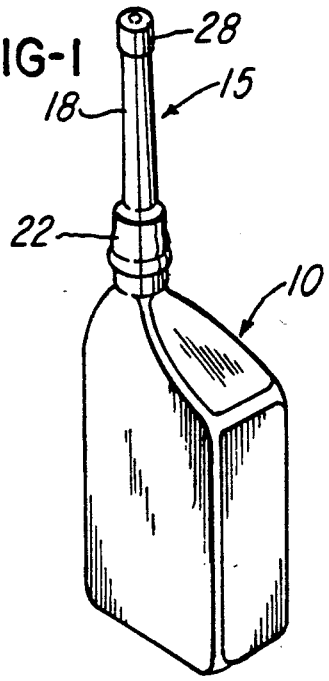
FIG. 1 is a perspective view of a tubular pouring and dispensing spout constructed in accordance with the invention and shown mounted on a liquid container of blow-molded plastics material.
Figure 2:
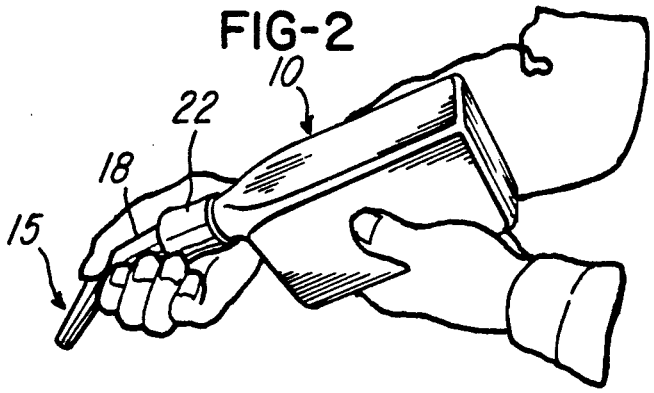
FIG. 2 is a perspective view illustrating the use of the pouring and dispensing spout of the invention to control the flow of liquid from the container.

FIG. 1 illustrates a liquid container 10 which is blow-molded of a plastics material and of the type commonly used for distributing motor oil. The container 10 includes an externally threaded annular neck portion 12 (FIG. 5) having a circumferentially extending and outwardly projecting rib 13 and an annular base portion 14. While the blow-molded motor oil container 10 is illustrated in FIGS. 1 and 2, it is to be understood that a pouring spout constructed in accordance with the present invention may be used with any type of container having an annular outlet portion defining an opening through which liquid within the container is poured.

In accordance with the present invention, a pouring and dispensing spout 15 includes a tubular body 18 which is formed of a resilient and flexible rubber-like material such as polyvinyl chloride (PVC). The tubular body 18 is produced by a dip-molding process in which an elongated metal mold is heated and then dipped into a supply of liquid PVC to form a coating or layer on the mold. The mold is then transferred to an oven where the layer or coating is cured to form the hollow body 18 with a closed outer end portion (not shown). After cooling, the body 18 is stripped from the mold with the assistance of a jet of pressurized air, and then the closed end portion or wall is trimmed from the body 18. Preferably, the dip-molding process is performed with conventional automated equipment wherein a continuous series of molds are carried by an endless conveyor through a preheating oven, a PVC dipping tank and then through a curing oven to a removal station where each molded body 18 is released and removed from its forming mold.

Figure 4:
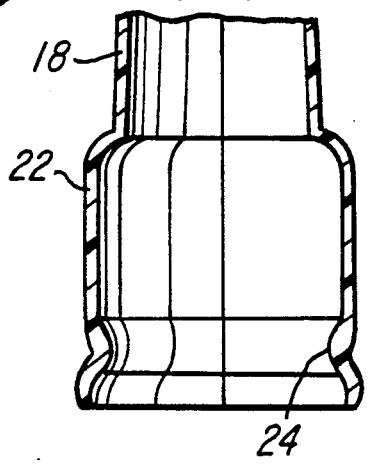
FIG. 4 is an enlarged fragmentary section of the base inlet portion of the pouring and dispensing spout shown in FIG. 1.
Figure 5:
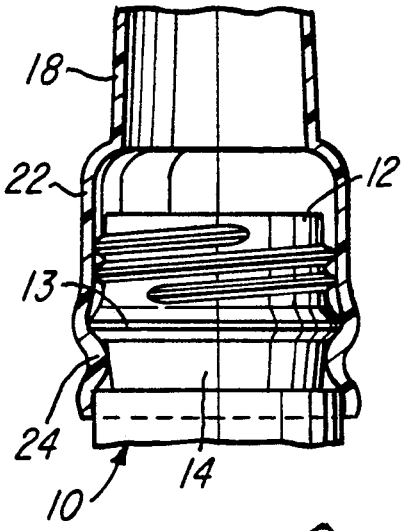
FIG. 5 is a fragmentary section similar to FIG. 4 and illustrating the pouring end dispensing spout mounted on the annular neck portion of the container shown in FIG. 1.
Figure 3:
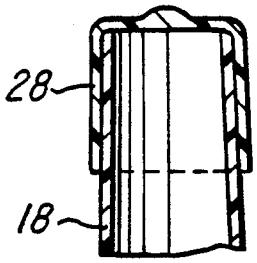
FIG. 3 is an enlarged fragmentary section of the spout outer end portion and closure cap shown in FIG. 1.

Referring to FIGS. 4 and 5, the dip-molded body 18 includes an enlarged annular base portion 22 which defines an inlet for the spout 15. The base portion 22 is adapted to be pressed onto the threaded neck portion 12 of the container 10 where it is retained by friction. The inlet or base portion 22 includes an inwardly projecting bead or rib 24 which is located to stretch-fit around the rib 13 on the container neck portion 12 and engage the annular or generally cylindrical portion 14 to form a liquid-tight seal. When it is desired to remove the spout 15 from the container 10, the body 18 is simply pulled from the container 10, and the bead 24 elastically expands to pass around the rib 13 and the external threads on the neck portion 12. As shown in FIG. 3, a resilient and flexible cap 28 is also formed of a PVC material by the dip-molding process and is frictionally retained on the outer end portion of the tubular body 18 to form an air-tight closure for the body.

Figure 6:
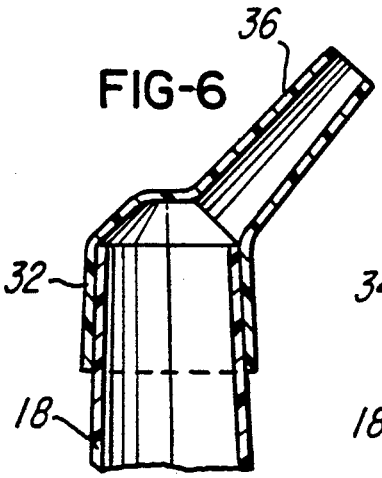
FIGS. 6 and 7 show enlarged fragmentary sections of the spout in FIG. 1 with different dispensing tip portions mounted on the spout.
Figure 7:
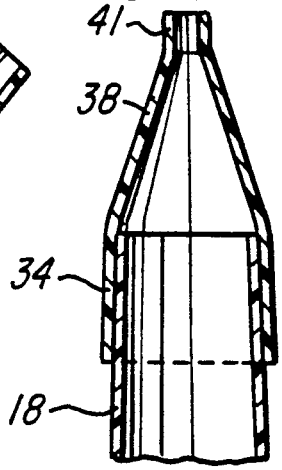

Referring to FIGS. 6 and 7, when it is desired to dispense the liquid from the container 10 into a smaller inlet of a receiver or at a lower flow rate, the spout body 18 is provided with a dispensing tip member 32 or 34 in place of the cap 28. The tip members 32 and 34 are both formed or produced by the dip-molding process of a PVC material and are retained on the tubular body 18 by friction engagement in the same manner as the cap 28. The tip member 32 includes a relatively small diameter spout tapered extension 36 which projects at an angle of about 45° with respect to the axis of the body 18. The dispensing tip member 34 includes a tapered or funnel-shaped portion 38 with a cylindrical end portion 41 defining a small circular outlet coaxial with the tubular body 18.

Figure 8:
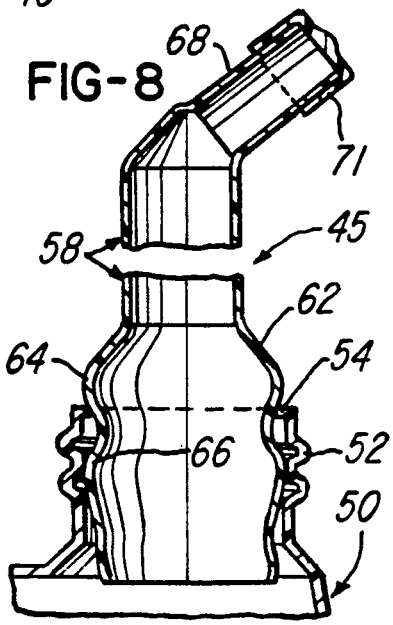
FIG. 8 is a fragmentary section of a pouring and dispensing spout constructed in accordance with another embodiment of the invention and shown mounted on a container.

Another embodiment of the invention is illustrated in FIG. 8. In this embodiment, a pouring and dispensing spout 45 is also formed of a resilient and flexible PVC material by the dip-molding process and is particularly suited for use with a liquid container 50 having an externally threaded annular neck portion 52 somewhat larger than the neck portion 12 of the container 10. Commonly, the neck portion 52 of the container 50 has a circular outlet defined by an inwardly projecting annular lip 54 formed or molded as an integral part of the neck portion 52.

The spout 45 includes a tubular body 58 having an enlarged inner end or base portion 62 with outwardly projecting annular rib portions 64 and 66 providing the end portion with a corrugated configuration in axial cross-section. The tubular body 58 also includes a generally cylindrical tip portion 68 which projects at an angle of about 45° with respect to the axis of the body 58. The tip portion 68 is provided with a removable end cap 71 which is molded in the same manner as the end cap 28 and is frictionally retained on the tubular tip portion 68.

As shown in FIG. 8, the enlarged end portion 62 of the body 58 is dimensioned to be pressed into the neck portion 52 of the container 50 and retained by the rib portion 66 frictionally engaging the inner surface of the neck portion. The rib portion 64 engages the inwardly projecting lip 54 and forms a liquid-tight seal to prevent liquid within the container 50 from flowing outwardly through the neck portion 52 around the base portion 62 of the body 58.

From the drawing and above description, it is apparent that a pouring and dispensing spout constructed in accordance with the present invention provides desirable feature and advantages. For example, the spouts 15 and 45 may be inexpensively produced by the dip-molding process, and the resilient, flexible and elastic characteristics of the base portions 22 and 62 provide for simple and liquid-tight couplings of the spouts to the corresponding neck portions 12 and 52 of the containers 10 and 50. In addition, each of the tubular bodies 18 and 58 may be easily pinched to close the internal passage within the spout so that the liquid container may be inverted and the spout inserted into a receiver opening without spilling the liquid. After the spout is inserted into the receiver opening, the finger pressure is released to control the flow of the liquid from the container into the receiver. The flow rate of liquid through the spout may be precisely controlled by adjusting the pinching pressure which varies the restriction within the spout. For example, the spout 15 is adapted to be used with motor oil containers for adding oil to a vehicle engine, and with the tip member 32, for adding oil to a small engine such as lawn mower engine. The spout 15 and tip member 32 may also be used for dispensing brake fluid from a container into a master brake cylinder reservoir or for adding power steering fluid to the power steering reservoir for a motor vehicle. In addition, an oil container 10 with the spout 15 and tip member 34 may be used in place of a conventional oil dispensing can by squeezing the blow-molded oil container 10. In addition, the pouring and dispensing spout 45 is ideally suited for dispensing liquids such as windshield washer fluids or engine coolant which are commonly sold in larger one gallon blow-molded containers. The spout 45 may also be used for dispensing liquids from metal containers such as, for example, a container of paint thinner used in body shops, especially when it is desired to control the flow rate of liquid from the container by simply changing the pinching force exerted by the fingers towards closing the spout. If a higher flow rate is desired through the spout 15 or 45, the blow-molded container may be squeezed one or more times.

While the forms of pouring and dispensing spout herein described constitute preferred embodiments of the invention, it is to be understood that the invention is not limited to these precise forms of spout, and that changes may be made therein without departing from the scope and spirit of the invention as defined in the appended claims.

The invention having been described, the following is claimed:

1. A pouring and dispensing spout in combination with a liquid container having a tubular neck portion with external helical threads and a circular surface adjacent said threads, said spout including an elongated one-piece and dip-molded tubular body of resilient and flexible rubber-like material and defining an internal passage, said body having a generally uniform wall thickness and including an enlarged annular inlet portion and a smaller annular outlet portion, said inlet portion having a removable friction engagement with said neck portion of said container and adapted to be pressed axially onto said neck portion, said inlet portion of said body also having a peripherally extending annular rib forming a liquid-tight seal with said circular surface of said neck portion, and said body having an annular intermediate wall portion which collapses to close said passage in response to pinching said wall portion with a user's fingers to permit inverting said container and then controlled dispensing of the liquid from said container.

2. The combination defined in claim 1 wherein said annular rib projects radially inwardly to engage said circular surface of said neck portion to form said liquid-tight seal.

3. The combination defined in claim 1 wherein said one-piece tubular body comprises polyvinyl chloride material.

4. The combination defined in claim 1 wherein said inlet portion of said body projects into said neck portion of said container, and said annular rib projects radially outwardly to engage said circular surface of said neck portion to form said liquid-tight seal.

5. The combination in claim 4 wherein said inlet portion of said tubular body has a center axis and a corrugated configuration in axial cross-section.

6. The combination defined in claim 1 and including a dip-molded tip member of resilient and flexible rubber-like material, said tip member having a substantially uniform wall thickness and surrounding said outlet portion of said body in removable friction engagement, and said tip member defines a discharge opening substantially smaller than said outlet portion of said body.

7. The combination defined in claim 6 wherein said tip member includes a tubular discharge portion defining said discharge opening and projecting at an acute angle with respect to the axis of said tubular body.

8. A method of dispensing a liquid from a container having an annular neck portion defining an outlet and having external helical threads adjacent a circular surface, comprising the steps of heating an elongated mold, dipping the mold into a liquid plastics material to form a layer on the mold, curing the layer with heat, stripping the layer from the mold to form an elongated one-piece tubular spout body of resilient and flexible rubber-like material, the body defining a passage and including an enlarged annular inlet end portion and a smaller annular outlet end portion and with the inlet end portion having a peripherally extending annular rib, pressing the inlet end portion of the body axially with respect to the neck portion of the container with the inlet end portion forming a friction engagement with the neck portion and the annular rib forming a liquid-tight seal with the circular surface of the neck portion, pinching the tubular body to close the passage, at least partially inverting the container and spout, and releasing the pinching of the body to permit liquid to flow from the container through the spout.

* * * * *